US005902143A

United States Patent [19]

Pan et al.

[11] Patent Number: 5,902,143

[45] Date of Patent: May 11, 1999

[54] RETAINER FOR USE WITH CARD

[75] Inventors: Hua-Tseng Pan, Taipei, Taiwan; Robert G. McHugh, Evergreen, Colo.; Chu-Mei Chen; Wen-Chun Pei, both of Taipei, Taiwan; Ming-Yow Hong, Taipei Hsien, Taiwan

[73] Assignee: Hon Hai Precision Ind. Co., Ltd., Taipei Hsien, Taiwan

[21] Appl. No.: 08/774,913

[22] Filed: Dec. 27, 1996

[51] Int. Cl.[6] ..... H01R 9/09

[52] U.S. Cl. ..... 439/327; 439/347

[58] Field of Search ..... 439/325, 327, 439/328, 347, 372

[56] References Cited

U.S. PATENT DOCUMENTS 4,165,909 8/1979 Yeager et al. ..... 439/327

4,486,061 12/1984 Grabbe et al. ..... 439/325

4,712,848 12/1987 Edgley ..... 439/327

5,650,917 7/1997 Hsu ..... 439/327

*Primary Examiner*—Hien Vu

[57] ABSTRACT

A retainer (10) for use with a card (200), comprises an elongated housing (12) defining a pair of towers (16) at two opposite ends. A rotatable member (22) positioned on the top portion (15) of the tower (16), includes a horizontal locking section (24) which can be horizontally engaged within a notch (202) of the card for latching the card (200) in position, and a vertical pivotal section (26) which can be rotated within the top portion (15) of the tower (16) and retain the rotatable member (22) in position with regard to the housing (12).

4 Claims, 11 Drawing Sheets

RETAINER FOR USE WITH CARD

BACKGROUND OF THE INVENTION

1. Field of the Invention

The invention relates to retaining means for holding a card in position thereof, and particularly to a retainer with horizontally rotative locking device for latching or unlatching the card therein.

2. The Related Art

The locking device for use with a card-like board in a card edge connector is generally of an ejector which is rotatably moved with regard to the housing of the connector wherein the ejector includes a locking protrusion at the top for latching the card-like board in the connector housing when such ejector is in a vertical locking position or for unlatching the card-like board from the connector housing when such ejector is in an slanted open position. This conventional card edge connectors and their retaining devices can be referred to U.S. Pat Nos. 5,429,523, 5,443,394, 5,445,531, 5,470,242, and 5,558,528. One disadvantage of this type retention mechanism of the card edge connector has been found that the rotation direction of the retainer/ejector is actuated generally in the same direction of the withdrawal direction of the card, i.e., the upward direction with regard to the centrally lengthwise axis of the housing. From another viewpoint, the insertion/withdrawal path of the card and the latching/unlatching rotation path of ejector are substantially on the same plane which is a vertical plane along the lengthwise axis of the housing. Thus, under a great vibration or an unintentional impact, the retainer/ejector may be pushed from its original vertical locking position to its slanted open position by the card, and loses its originally designed locking function.

Therefore, an object of the invention is to provide a retainer which may cooperate with a card edge connector for holding therein a card wherein the retention device can reliably and efficiently retain the card without the possibility of inadvertent disengagement of the card from the retainer.

SUMMARY OF THE INVENTION

According to an aspect of the invention, a retainer for use with a card, comprises an elongated housing defining a pair of towers at two opposite ends. A rotatable member positioned on the top portion of the tower, includes a horizontal locking section which can be horizontally engaged within a notch of the card for latching the card in position, and a vertical pivotal section which can be rotated within the top portion of the tower and retain the rotatable member in position with regard to the housing.

DETAILED DESCRIPTION OF THE PREFERRED EMBODIMENTS

Figure 1:
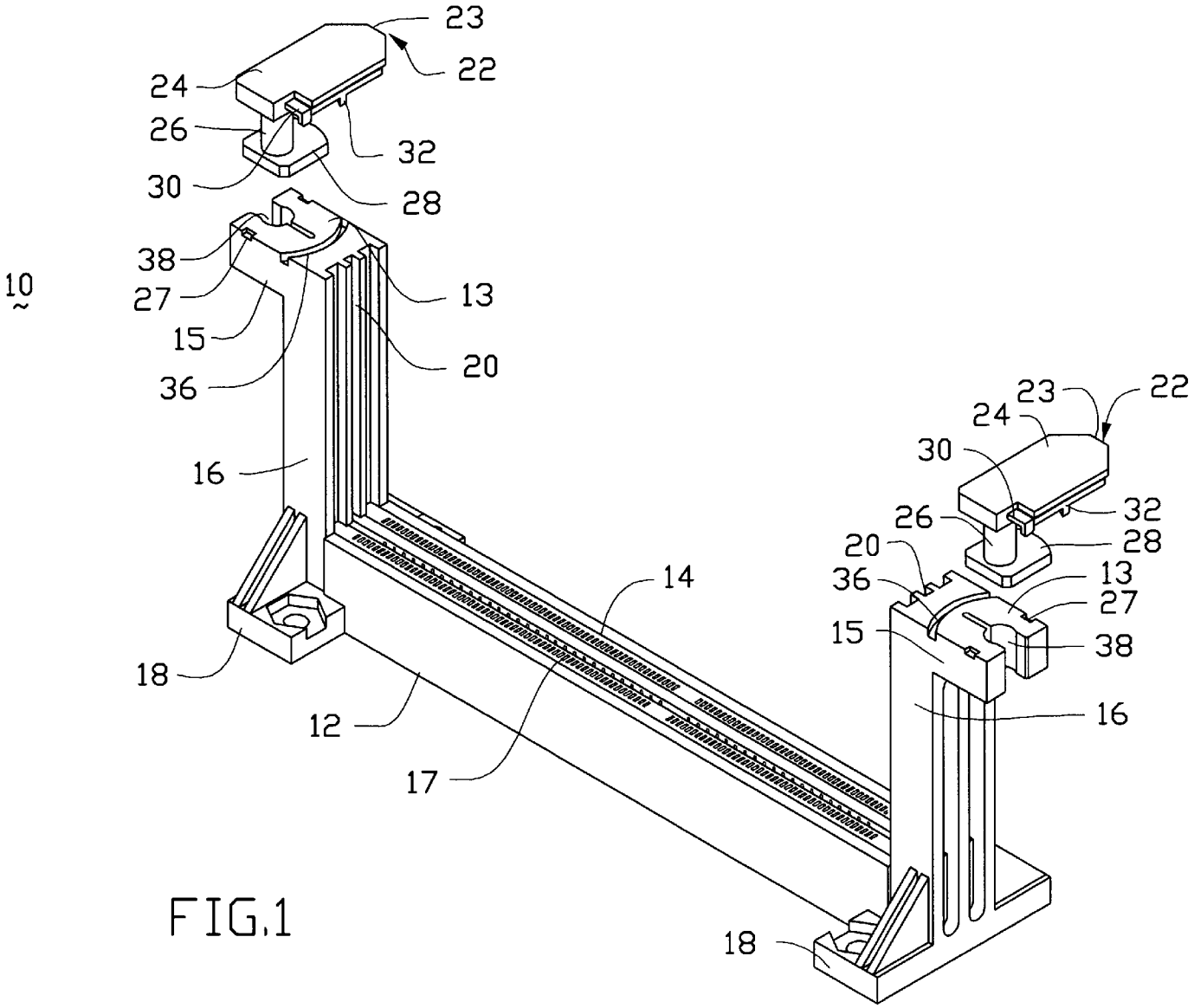
FIG. 1 is an exploded perspective view of a first embodiment of a retainer according to the invention.
Figure 2:
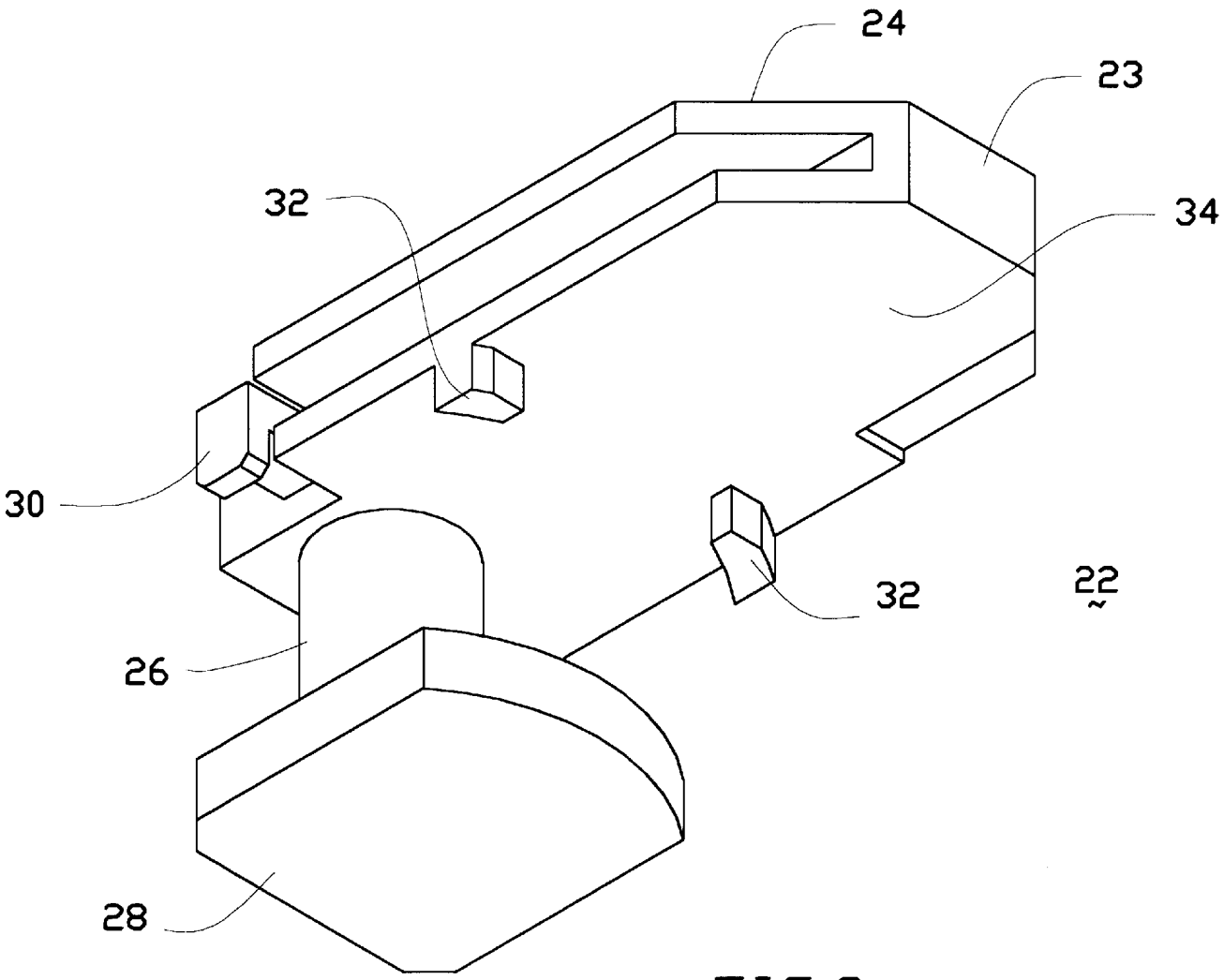
FIG. 2 is an bottom perspective view of a rotatable member of the retainer of FIG. 1.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–4 wherein a retainer 10 includes an elongated housing 12 defining a cavity 14 receiving a card edge connector 17 therein. The basic structures of the retainer and the corresponding card edge connector can be referred to the copending application Ser. No. 08/745,099 filed on Nov. 7, 1996.

Figure 11:
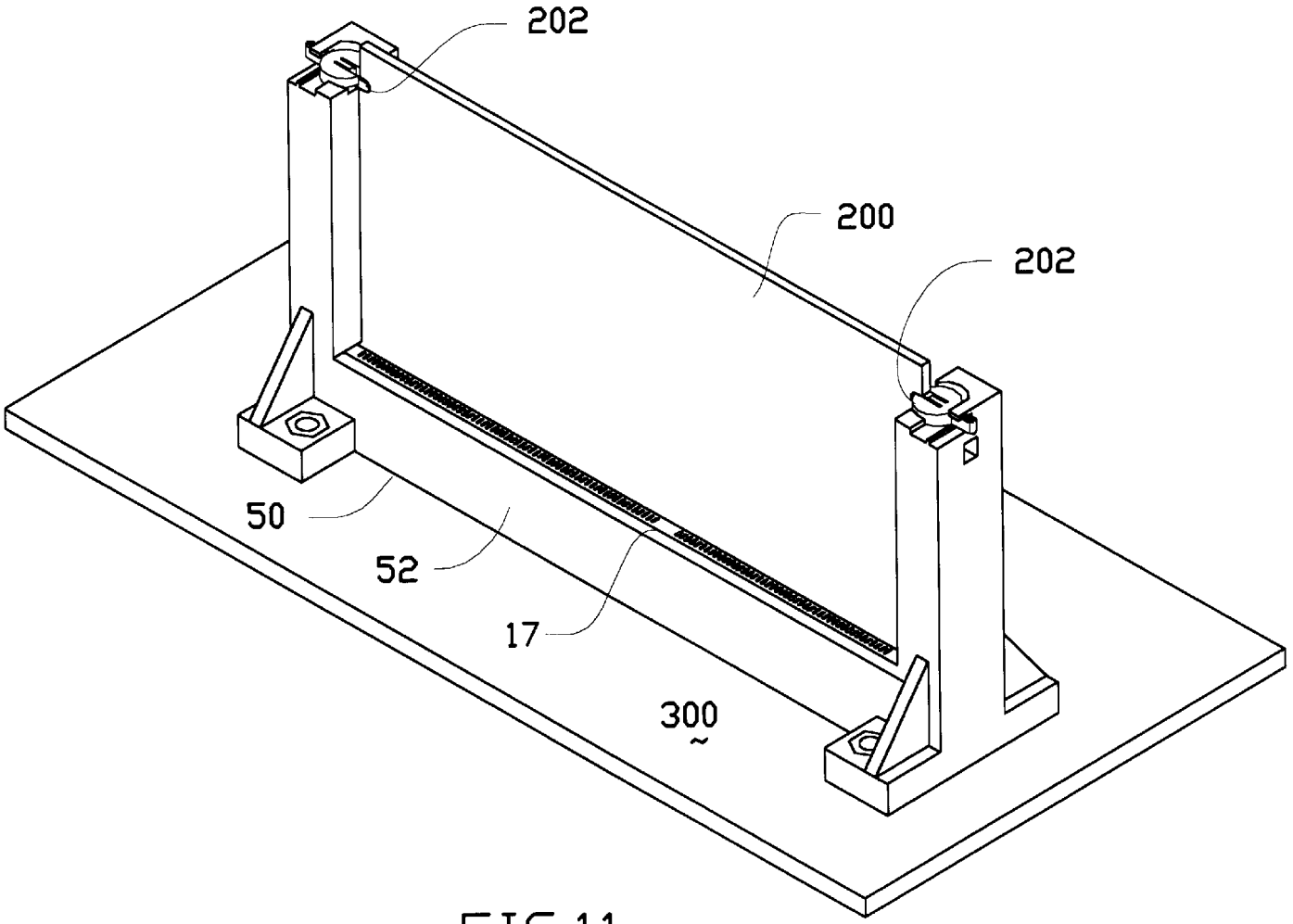
FIG. 11 is a perspective view of the assembled retainer of FIG. 5 incorporating the inserted card.

A pair of towers 16 are formed at two opposite ends of the housing 12, each includes a stand 18 at the bottom portion for mounting on a mother board 300 (FIG. 11). A channel 20 extends vertically in the innermost side of the tower 16 for sandwiching a corresponding side edge of a card 100 (FIG. 4) inserted into the connector 17. Disposed on the top of a horizontal section 15 of the tower 16 is a rotatable member 22 including a horizontal latching plate 24 on a top portion, a vertical pivotal shaft 26 on a middle portion and a seat 28 on a bottom portion of the rotatable member 22 wherein the horizontal latching plate 24 comprises an upward deflectable tab 30 disposed on the rear portion thereof adjacent the pivotal shaft 26 for engagement within a recess 27 in the horizontal section 15 of the tower 16. The horizontal latching plate 24 further includes a pair of guiding protrusions 32 extending downward from a bottom surface 34 thereof for engagement within an arc-like slit 36 in the horizontal section 15 of the tower 16. Moreover, the horizontal section 15 of the tower 16 defines a cylinder-like opening 38 for receiving the vertical pivotal shaft 26 of the rotatable member 22.

Figure 3:
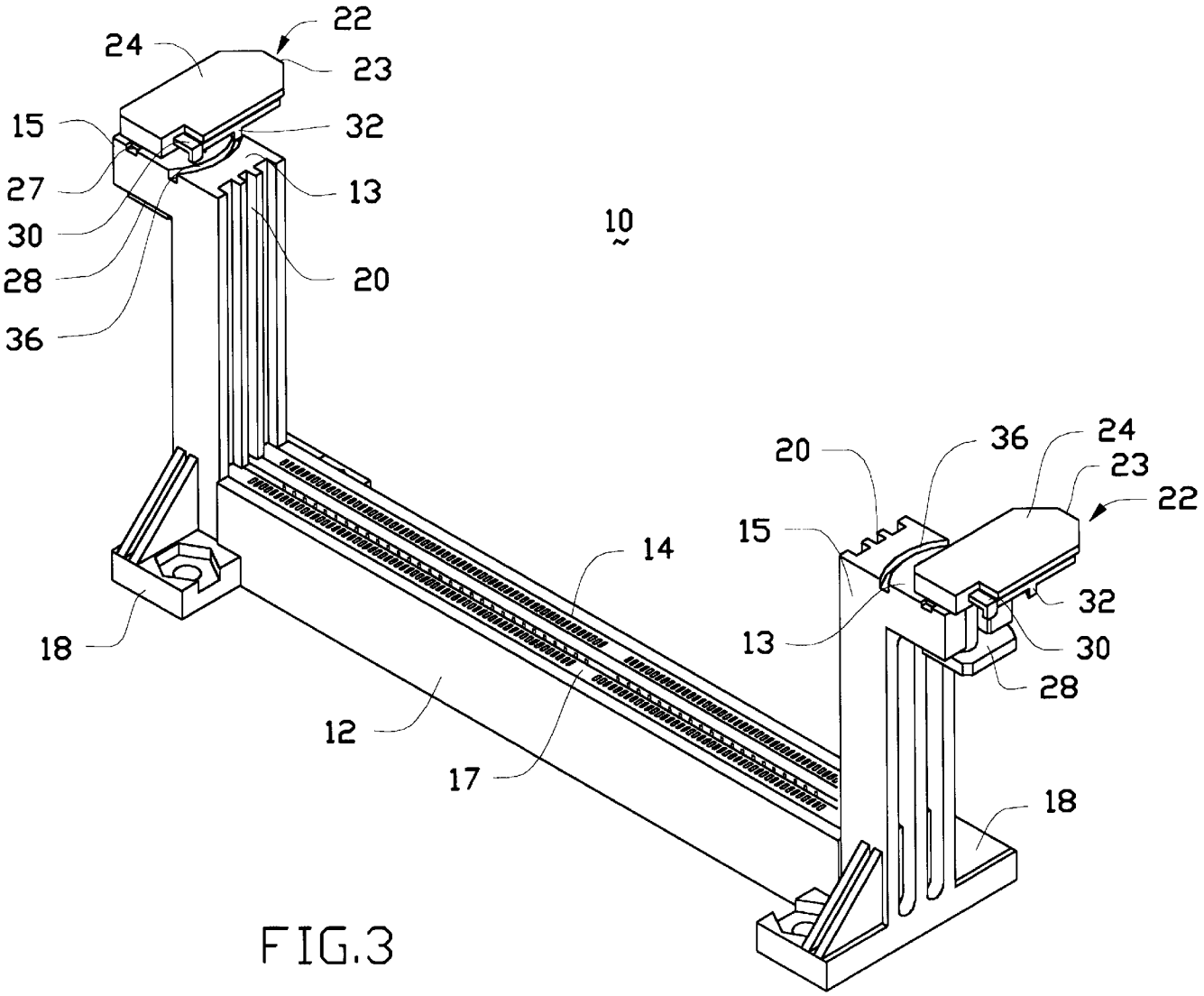
FIG. 3 is a perspective view of the assembled retainer to show the rotatable member is in an unlatching position.

Thus, as shown in FIG. 3 the rotatable member 22 can be attached to the tower 16 wherein the pivotal shaft 26 is received within the opening 38 in the horizontal section 15 of the tower 16 and the horizontal section 15 is generally sandwiched between the horizontal latching plate 24 and the seat 28 of the rotatable member 22. Under the situation as shown in FIG. 3, a lengthwise direction of the rotatable member 22 is positioned angularly (i.e., perpendicularly) with regard to a lengthwise direction of the housing 12. In other words, the rotatable member 22 is positioned angularly with regard to the horizontal section 15 of the tower 16.

Figure 4:
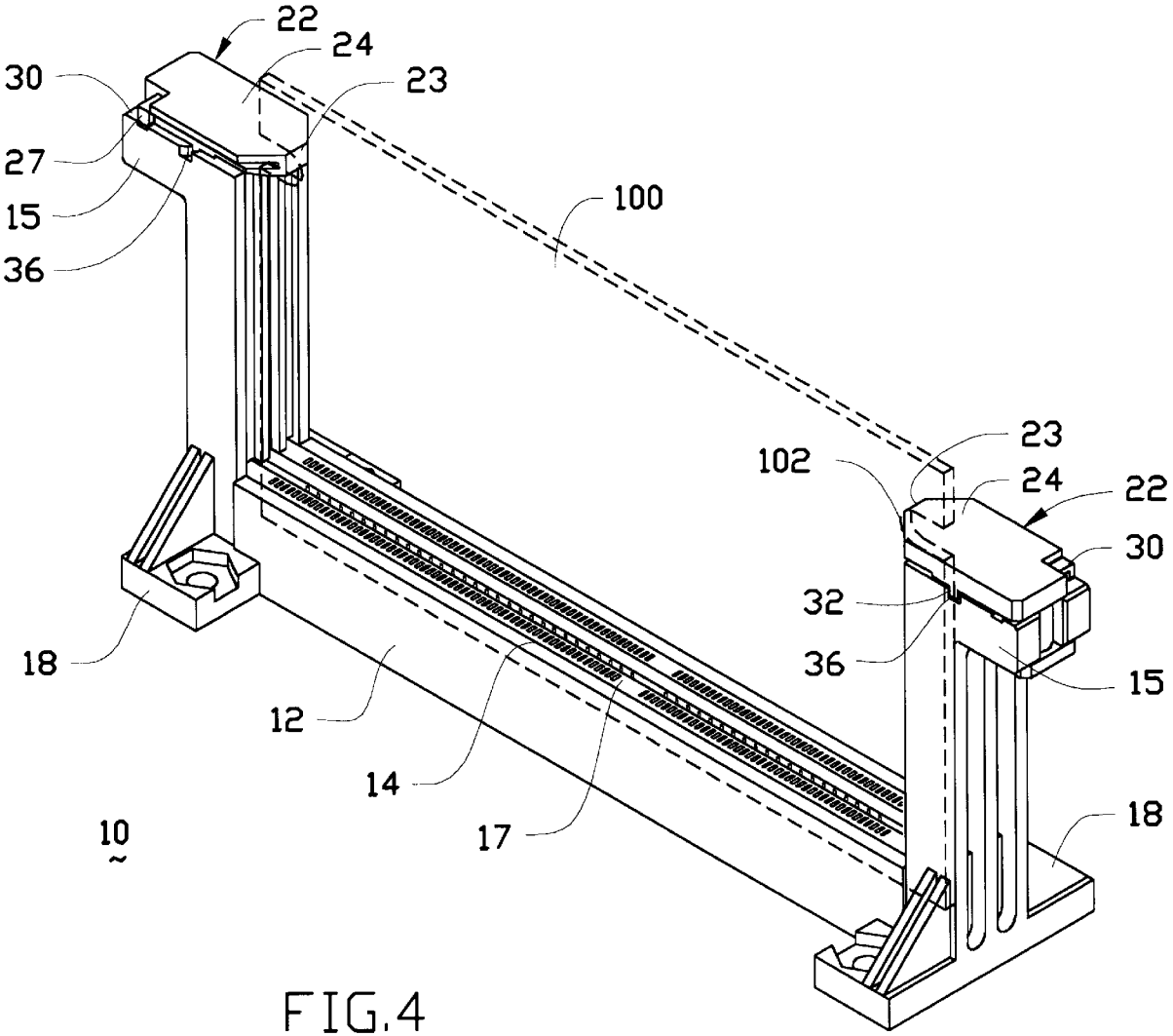
FIG. 4 is a perspective view of the assembled retainer to show the rotatable member is in a latching position.

Referring to FIG. 4, after the card 100 has been inserted into the card edge connector 1 received in the cavity 14 defined by the housing 12 of the retainer 10 by moving the side edges of the card 100 downwards along the channels 20 of the towers 16 of the retainer 10, the rotatable member 22 is horizontally rotated about the vertical pivotal shaft 26 until it is aligned with the horizontal section 15 of the tower 16 along the lengthwise direction of the housing 12. Under the situation as shown in FIG. 4, a front tip portion 23 of the horizontal latching plate 24 engages within a side notch 102 of the card 100 to retain the card 100 in position whereby an upward withdrawal of the card 100 from the card edge connector 1 and the associated retainer 10 is prevented.

It is understood that during the horizontal rotation of the rotatable member 22 from its angular position (FIG. 3) to its alignment position (FIG. 4) with regard to the horizontal section 15 of the tower 16, the guiding protrusions 32 of the rotatable member 22 move along the arc-like slit 36 in the horizontal section 15, and the tab 30 of the rotatable member 22 is upward deflected by engagement with a top surface 13 of the horizontal section 15 until the tab 30 reaches and is received within the recess 27 of the horizontal section 15 of the tower 16. Accordingly, the rotatable member 22 can be retained in position with regard to the retainer 10 without clockwise or counter-clockwise rotation. Therefore, the card 100 can be held in position in the card edge connector 1 by the rotatable member 22 without upward withdrawal therefrom.

In contrast, if the card 100 is intended to be released from the card edge connector 1 and the retainer 10, the rotatable member 22 can be manually and forcibly rotated to have the tab 30 leave the recess 27 until the front tip portion 23 of the horizontal latch plate 24 completely leaves the side notch 102 of the card 100. Therefore, the card 100 can be successively upward moved from the card edge connector 1 and the retainer 10.

FIGS. 5–11 illustrates another embodiment of the invention wherein the retainer 50 includes an insulative elongated housing 52 with two opposite towers 54 positioned at two opposite ends thereof. The housing 52 defines a cavity 56 for receiving a card edge connector 2 therein and each tower 54 defines a channel 57 on the innermost side for receivably aligning the corresponding side edges of the card 200.

A rotatable member 58 is rotatably positioned on the top of the tower 54 wherein the rotatable member 58 includes a rotation dish 60 with a pivotal shaft 62 extending downward from its under-surface and a radial cut-away 64. A lever 66 is integrally formed with the rotation dish 60 and generally opposite to the cut-away 64 in a diametrical direction.

A coil-like torque spring 66 is circumferentially disposed on the pivotal shaft 62 wherein one end 68 of the spring 66 is retained within an aperture 70 in the tower 54 and the other end 72 of the spring 66 is retained within an aperture 74 (FIGS. 6 and 7) of the rotatable member 58.

The tower 54 defines a vertical countersink 76 for receiving the pivotal shaft 62 with its spring 66. A c-ring 78 is attached, from the side window 79, to the ring slot 80 in the shaft 62 (FIG. 7) for securing the pivotal shaft 62 and its integrally formed rotatable member 50 to the tower 54. By means of the spring 66, the rotatable member 58 can be generally retained angularly with regard to the housing 52 as shown in FIG. 9.

Figure 8:
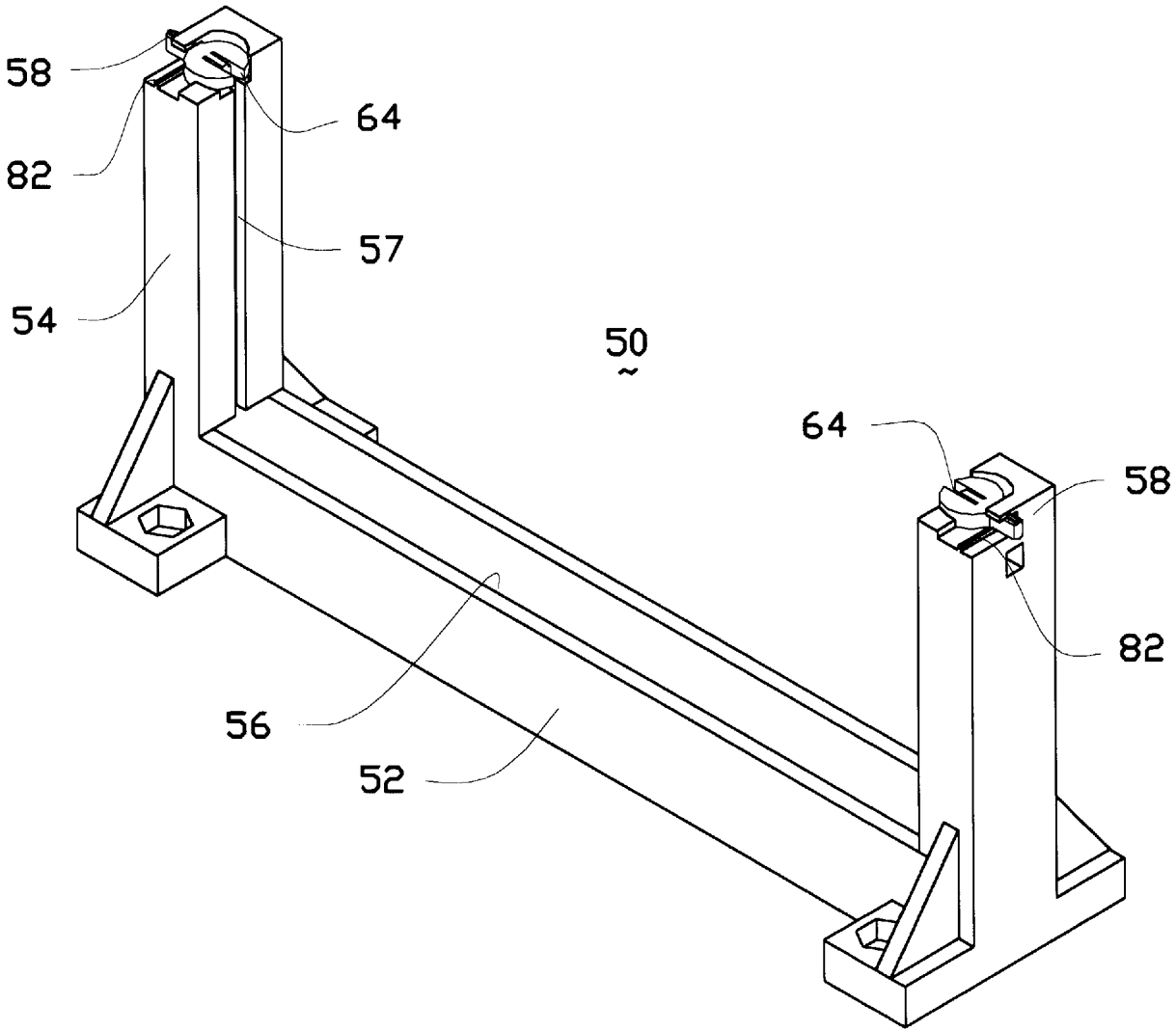
FIG. 8 is a perspective view of the assembled retainer of FIG. 5.
Figure 10:
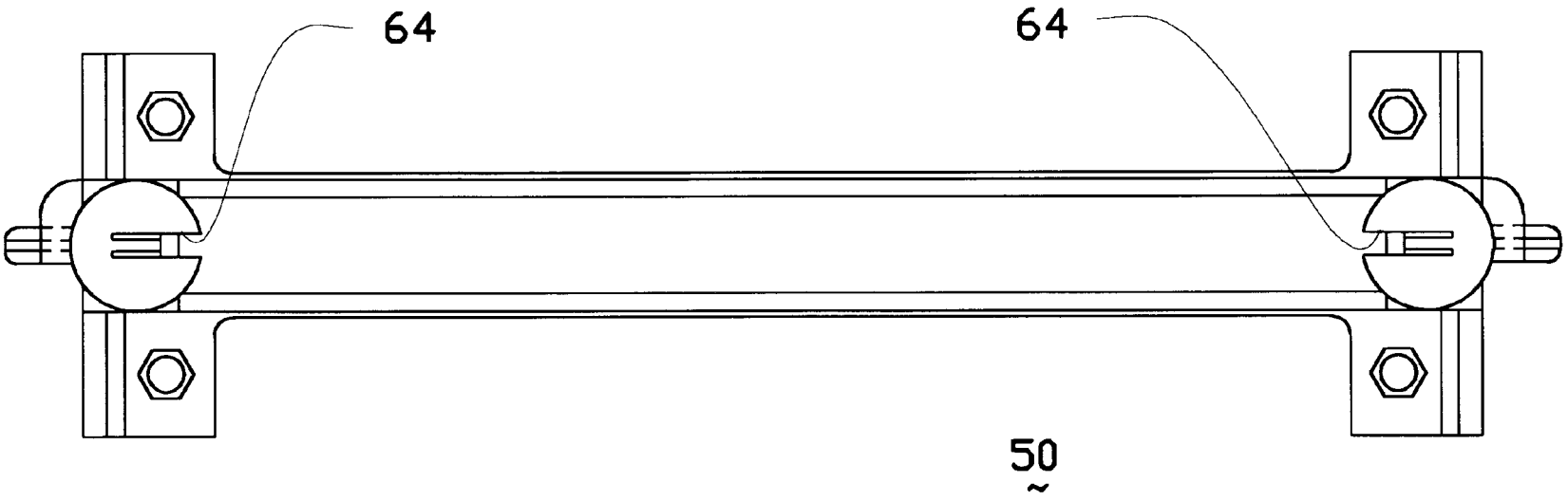
FIG. 10 is a top plan view of the assembled retainer of FIG. 5 to show the rotatable member is in an unlatching position.

As shown in FIGS. 8, 10 and 11, to facilitate insertion of the card 200 into the corresponding card edge connector 2 and the associated retainer 50, the rotatable member 58 is intentionally rotated to have the cut-away 64 in alignment with the corresponding channel 57 of the tower 54. Thus, the card 200 can be inserted into the card edge connector 2 along the channels 57 without obstruction of the rotation dish 60.

Figure 5:
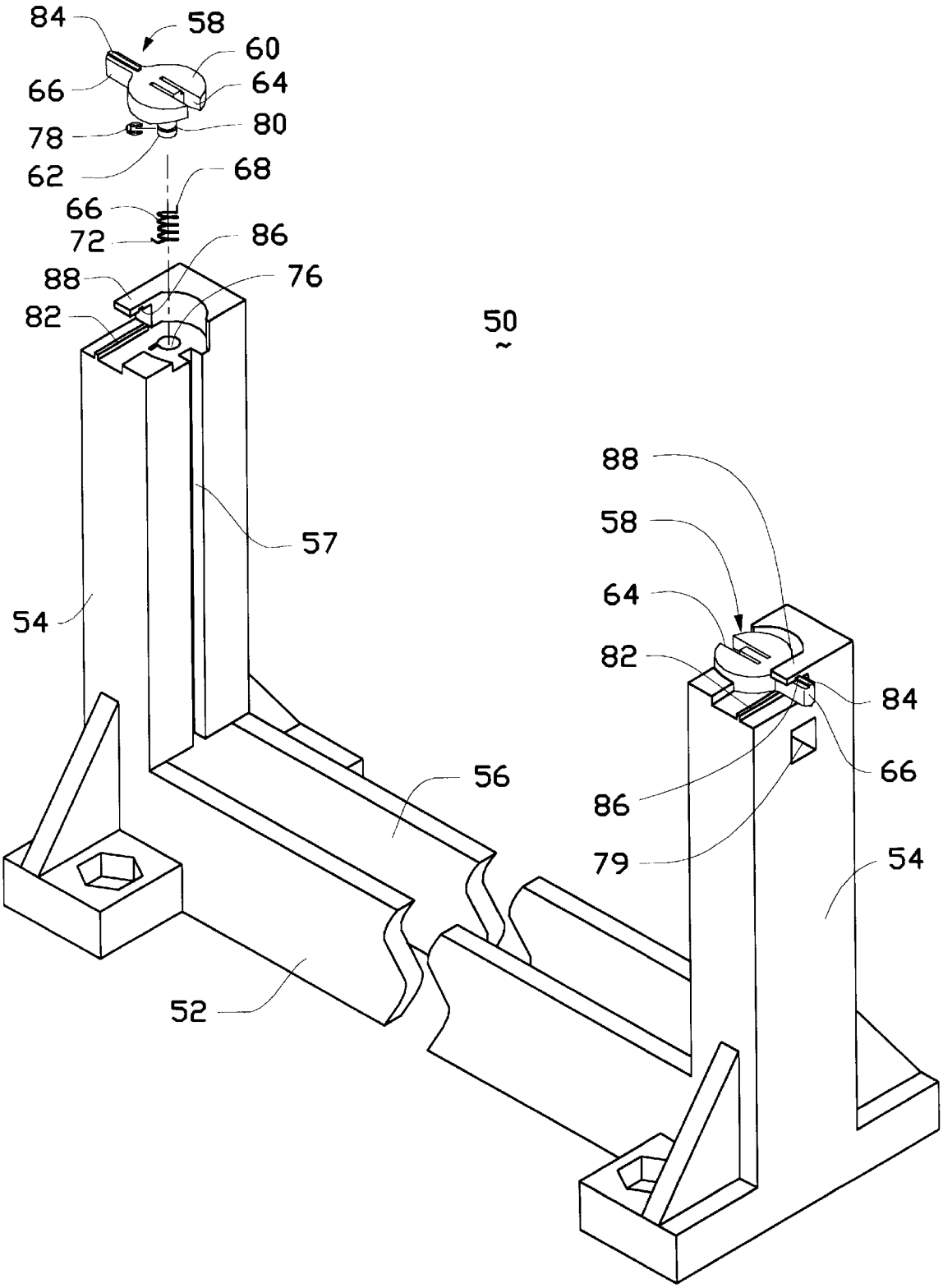
FIG. 5 is an exploded perspective view of a second embodiment of the retainer according to the invention.
Figure 7:
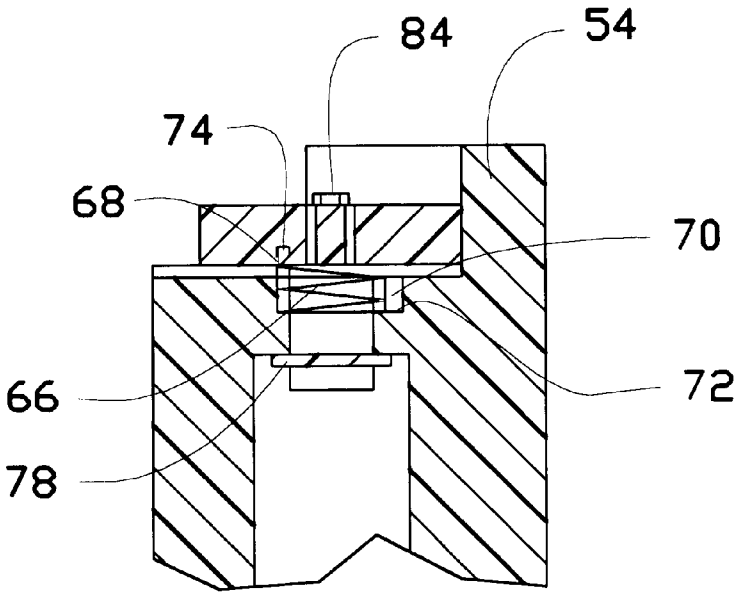
FIG. 7 is a partial cross-sectional view of the assembled retainer of FIG. 5.
Figure 6:
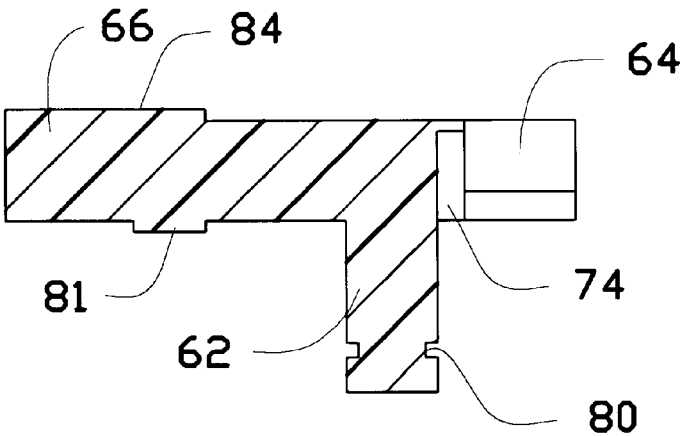
FIG. 6 is a cross-sectional view of the rotatable member of FIG. 5.

Referring to FIGS. 5–7, to resist the restoring moment resulting from the spring 66 and efficiently maintain the rotation dish 60 to have it cut-away 64 aligned with the channel 57, the lever 66 has a first projection bar 81 on the under-surface for cooperation with a second projection bar 82 formed on the tower 54, and has a third projection bar 84 on the top surface thereof for cooperation with an indent 86 formed on the under surface of an engagement bar 88 of the tower 54.

Figure 9:
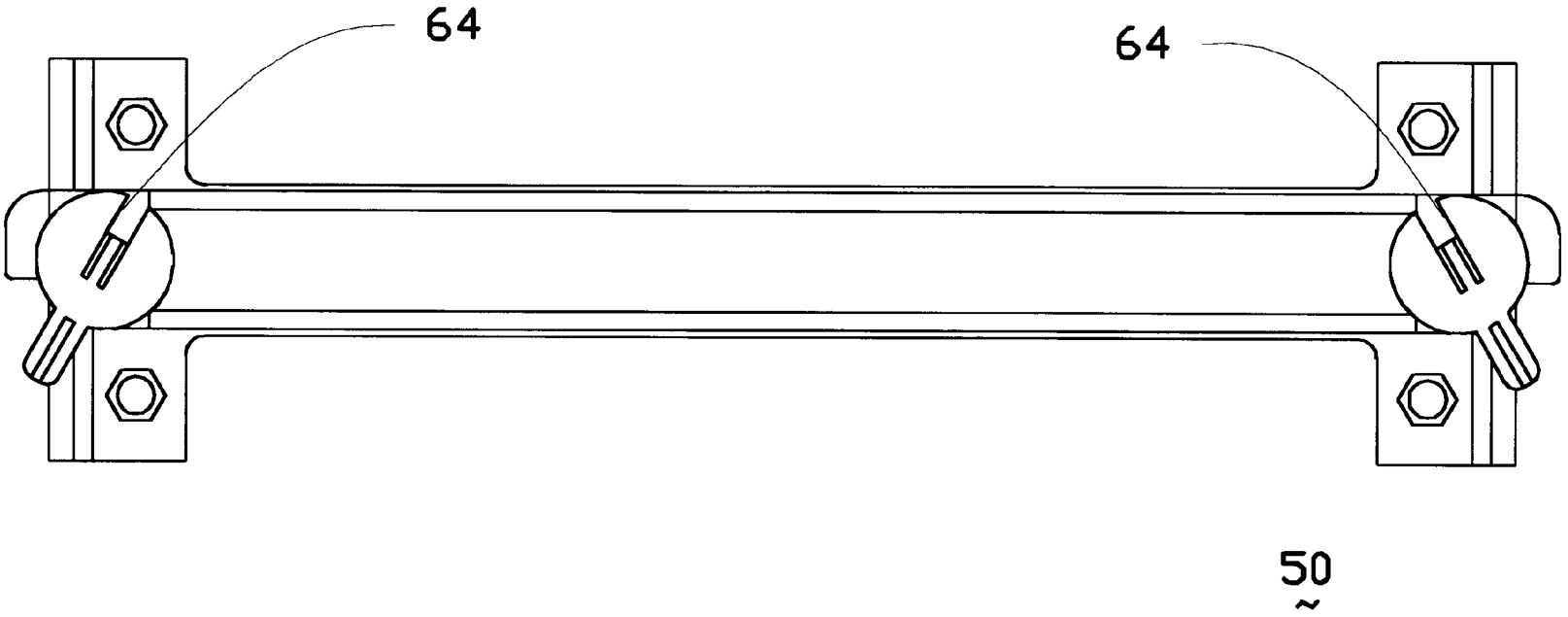
FIG. 9 is a top plan view of the assembled retainer of FIG. 5 to show the rotatable member is in a latching position.

After the card 200 has been installed into the card edge connector 17, the rotatable member 58 can be actuated back to its original angular position, as shown in FIG. 9, by manually rotating the lever 66 about the pivotal shaft 62. Thus, the rotation dish 60 may be engaged within the notch 202 of the card 200 for preventing upward withdrawal of the card 200 from the card edge connector 2 and its associated retainer 50.

Figure 12:
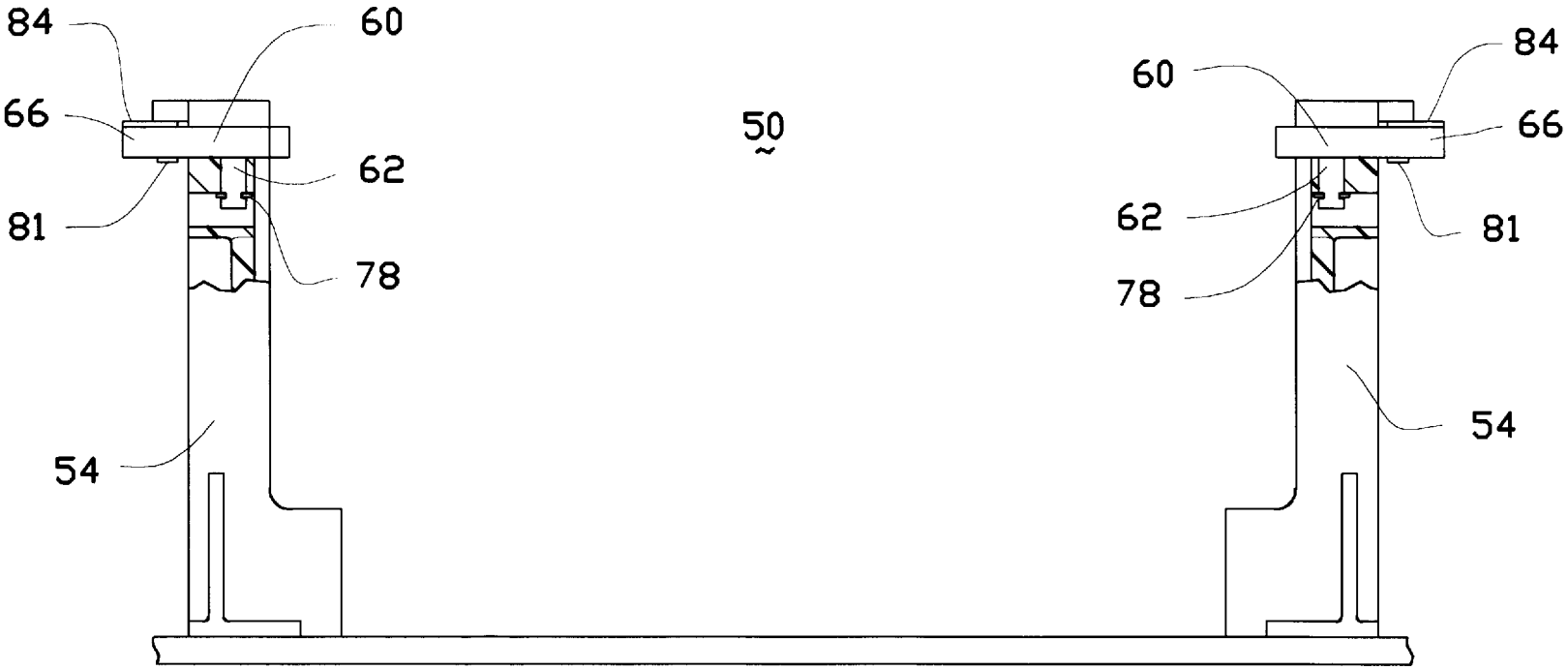
FIG. 12 is a perspective view of another embodiment of the retainer according to the invention.

FIG. 12 shows a third embodiment of the invention having the similar structure with the second embodiment wherein the housing 52 has been eliminated to have two opposite towers 54 may be relatively lengthwise moved with and spaced away from each other for accommodate different length card edge connectors therebetween for commonly receiving variable length card therein.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. For example, the towers can be designedly integrally formed with the card edge connector. In other words, the card edge connector has its own horizontally rotatable retention devices for latching the inserted card. This modified type may be referred to the aforementioned conventional card edge connectors which integrally have their own retention devices, i.e., ejectors, at two opposite ends of the housing of the connector.

Therefore, person of ordinary skill in this field are to understand that all such equivalent structures are to be included within the scope of the following claims.

We claim:

1. A combination of a retainer and a card edge connector, comprising:

a retainer, comprising:

an elongate insulative housing defining a cavity;

a tower extending upright from a lateral end of the housing and forming a horizontal section perpendicular to the tower; and a rotatable member having an upper elongate latching plate, a middle shaft rotatably engaging with the horizontal section of the tower and a lower seat cooperating with the upper elongate latch plate to sandwich the horizontal section therebetween; and the card edge connector received in the cavity of the housing of the retainer;

wherein when the rotatable member is rotated to a first position where a lengthwise direction of the latching plate aligns with a lengthwise direction of the housing, the latching plate extends into a space above the card edge connector whereby a card inserted into the card edge connector can be retained in position by an engagement between the latching plate and the card, and when the rotatable member is rotated to a second position where the lengthwise direction of the latching plate forms an angle with the lengthwise direction of the housing, the latching plate escapes from the space above the connector whereby the engagement between the latching plate and the card is released so that the card can be withdrawn from the card edge connector.

2. The combination as defined in claim 1, wherein the tower defines a channel for receiving a side edge of the card inserted into the card edge connector.

3. The combination as defined in claim 1, wherein the rotatable member further includes a tab received in a recess formed in the tower when the rotatable member is rotated to the first position thereby retaining the rotatable member in the first position.

4. The combination as defined in claim 1, wherein the rotatable member further includes protrusions moving in an arc-like guiding slot in the tower when the rotatable member is rotated.

* * * * *